United States Patent [19]

Lasker

[11] Patent Number: 4,651,260

[45] Date of Patent: Mar. 17, 1987

[54] ROADWAY LUMINAIRE

[75] Inventor: Martin L. Lasker, Edison, N.J.

[73] Assignee: Prescolite Inc., San Leandro, Calif.

[21] Appl. No.: 664,376

[22] Filed: Oct. 24, 1984

[51] Int. Cl.[4] ..... F21V 7/00

[52] U.S. Cl. ..... 362/281; 362/297; 362/323; 362/347

[58] Field of Search ..... 362/297, 343, 346, 347, 362/280, 281, 282, 283, 323, 241, 301

[56] References Cited

U.S. PATENT DOCUMENTS

| | | | |
|---|---|---|---|
| 1,513,848 | 11/1924 | Moore | 362/283 |
| 2,017,716 | 10/1935 | Halvorson . | |
| 2,128,470 | 8/1938 | Phillips | 362/297 |
| 2,327,186 | 8/1943 | Halvorson . | |
| 3,096,030 | 7/1963 | Harling | 362/297 |
| 3,163,365 | 12/1964 | Stevens | 362/297 |
| 3,324,290 | 6/1967 | Lasker . | |
| 3,359,415 | 12/1967 | Lasker . | |
| 3,377,481 | 4/1968 | Lasker . | |
| 3,578,965 | 5/1971 | Tawil . | |
| 3,610,915 | 10/1971 | Moore | 362/282 |
| 3,651,320 | 3/1972 | Lasker . | |
| 3,836,767 | 9/1974 | Lasker . | |
| 4,007,365 | 2/1977 | Stempfle et al. | 362/283 |
| 4,041,306 | 8/1977 | Compton et al. | 362/297 |
| 4,053,766 | 10/1977 | Brass | 362/301 |
| 4,096,555 | 6/1978 | Lasker | 362/302 |
| 4,261,029 | 4/1981 | Mousset | 362/283 |
| 4,310,876 | 1/1982 | Small, Jr. et al. | 362/301 |

*Primary Examiner*—Craig R. Feinberg
*Assistant Examiner*—David A. Okonsky
*Attorney, Agent, or Firm*—Bielen and Peterson

[57] ABSTRACT

A roadway luminaire utilizing a source of light which is reflected outwardly from the luminaire by a first and second reflector in side-by-side configuratuion. The second reflector is also positioned to one side of the source of light. The light from the first reflector is adjusted to reinforce light coming from the second reflector in a predetermined direction.

8 Claims, 15 Drawing Figures

FIG. 1
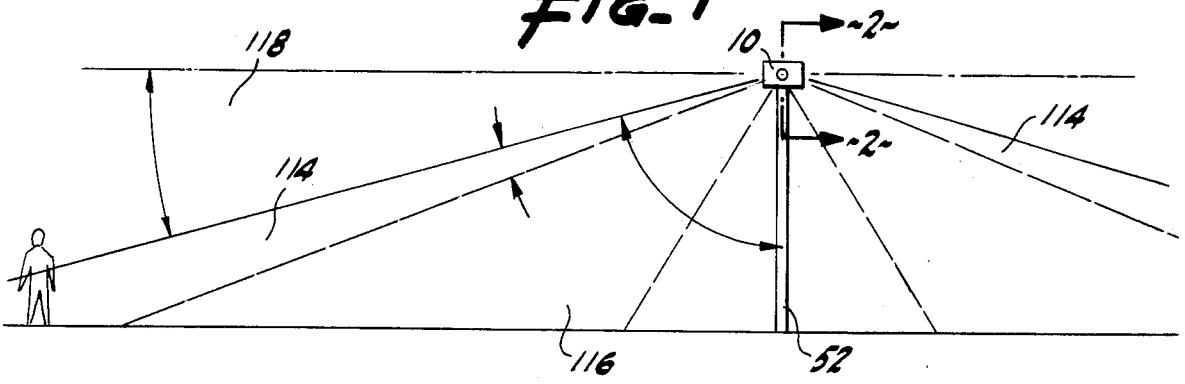
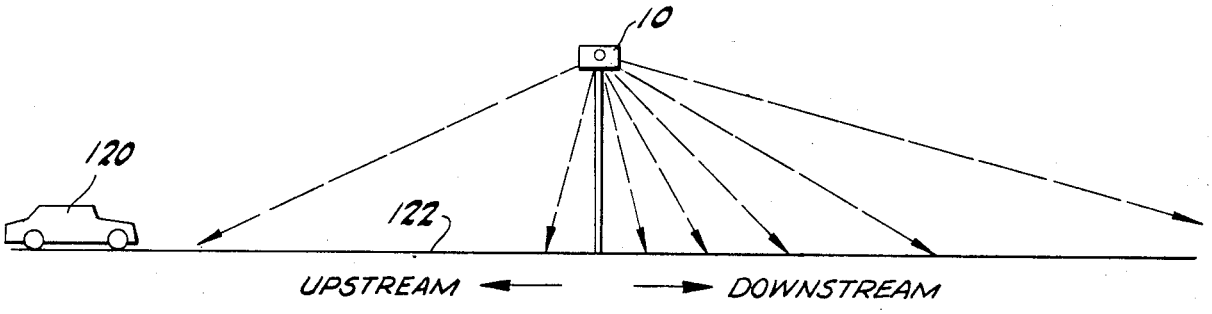
FIG. 7
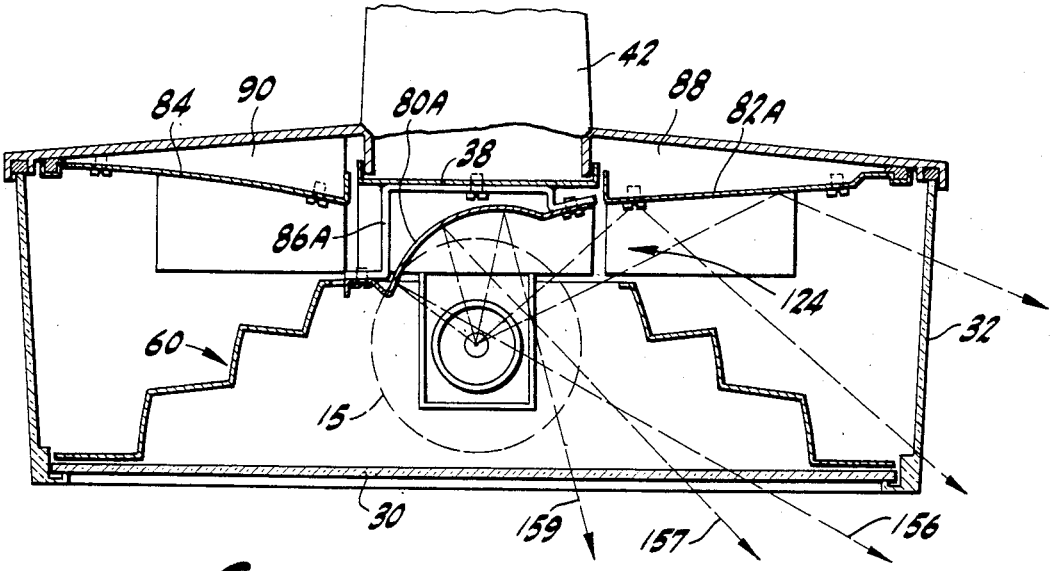
FIG. 6

~3~
42
100
44
46
56
38
112
80
54
44
50
48
108
40
52
68
34
14
16
70
36
15
12
58
30
~3~

76
42
18
78
92
38
88
20
98
44
90
80
86
44
94
96
110
84
B
82
106
28
108
62
60
24
A
64
32
14
36
66
22
72
26
30
74

ONE WAY ROADS WITH UNITS ON ONE SIDE ONLY

TWO WAY ROADS WITH UNITS ON ONE SIDE ONLY

ON WIDER TWO WAY ROADS WITH UNITS ON BOTH SIDES

ROADWAY LUMINAIRE

BACKGROUND OF THE INVENTION

The present invention relates to a novel roadway luminaire which is useful in that it may be adjusted to conform to a particular standard of illumination.

Luminaires which are employed in earlier lighting are generally of the "box cut-off" and "prismatic lens" types. The "prismatic lens" type luminaire relies on refraction of light rays from the source lamp to direct light to the high angle zone generally defined between 65 and 75 degrees in relation to a line projected downwardly from the luminaire which is perpendicular to the ground surface. The "prismatic lens" system has a tendency to produce light at higher than normal viewing angles (generally above 75 degrees) which are undesirable and often termed as "glare" within the normal angles of vision of a motorist.

The "box cut-off" luminaire such as the type shown in the U.S. Pat. No. 4,053,766 greatly reduces glare at normal viewing angles while still producing a broad distribution of light similar to that of "prismatic lens" type luminaire. However, the "box cut-off" luminaire suffers restrictions in that the portion of the reflector directing light to the high angles of emission is quite small, about a 30 degree sector around the light source. Thus, the remaining reflectors are restricted to directing light to the lower angles of emission which may produce an undesirable result, by creating disuniform levels of illumination on the ground surface ("hot spots").

Moreover, the standard for roadway and area lighting may be described by the "illuminance" system or the "luminance" system. The former systems depends on the amount of light falling on a ground surface and the latter depends on the light reflected by the ground toward the viewer. As may be apparent, the "luminance" standard thus takes into consideration the different levels of specularity of the road surface. For example, a diffuse surface tends to reflect light in all directions and requires a pattern of distribution from a lighting system which is very much like the one for the "illuminance" system. On the other hand, a highly specular roadway surface, one which tends to reflect light outwardly from the source must be reinforced on the downstream side of the luminaire and diminished on the upstream side of the luminaire to produce a more uniform luminance on the surface, as viewed by a motorist driving in that direction.

A roadway luminaire which addresses and solves these problems encountered in the lighting field would be a great advance therein.

SUMMARY OF THE INVENTION

In accordance with the present invention a novel and useful roadway luminaire useable under illuminance or luminance standards of illumination is provided.

The roadway luminaire of the present invention utilizes a source of light which may be mounted in a housing. The housing may include a bottom opening and a side opening positioned at a selected angle in relation to the bottom opening. Both the bottom and side openings would permit the passage of light from the source. The bottom and side openings may also include lenses.

The invention also provides for a first reflector supported by the housing a certain distance from the source light. The first reflector would include a reflecting or specular surface which would direct light from the source and away from the luminaire through the bottom opening. The first reflector may include means for adjusting the direction of the light reflected therefrom.

A second reflector is also provided and supported adjacent the first reflector. The second reflector possesses a second surface for reflecting light away from the source of light to one side of the same. Thus means for adjusting the direction of light emanating from the first reflector may be employed to reflect light in relation to the light coming from the second reflector. The second reflector would reflect light to one side of the source of light and through the side opening of the housing.

The luminaire of the present invention may also embrace the use of a third reflector such that the first reflector is positioned between the second and third reflectors. The third reflector would also have a reflecting surface for reflecting light from the source to another side of the source of light and through the side opening of housing. The means for adjusting the direction of the light reflected from the first reflector may also serve to block light from the source to the third reflector.

In many cases a fourth reflector may be employed in the luminaire of the present invention. The fourth reflector is located on the one and another side of the source of light and is displaced from the second and third reflectors toward the bottom opening of the housing. The fourth reflector, again, has a specular surface for directing light from the source to the one and another side of the source of light. Such light would pass through the bottom opening of the housing.

It may be apparent that a novel and useful roadway luminaire has been described. It is therefore an object of the present invention to provide a roadway luminaire which is an improvement of the conventional box cut-off type luminaires which delivers higher levels of illumination at high angles of emission.

It is another object of the present invention to provide a roadway luminaire which possesses great energy efficiency, thus permitting wider spacing between a plurality of such luminaires in a particular area being lighted.

It is yet another object of the present invention to provide a roadway luminaire which possesses an increased zone of reflection of light directed at high angles of emission.

It is another object of the present invention to provide a roadway luminaire which is useable under the "illuminance" or "luminance" standards of illumination since light may be adjustably reflected in the upstream or downstream areas in relation to a moving vehicle.

It is further object of the present invention to provide a roadway luminaire which produces very low glare from all normal viewing angles.

The invention possesses other objects and advantages especially as concerns particular characteristics and features thereof which will become apparent as the specification continues.

BRIEF DESCRIPTION OF THE DRAWINGS

FIG. 1 is a side elevational view of the luminaire of the present invention in use.

FIG. 6 is a sectional view of another embodiment of the luminaire of the present invention.

FIG. 7 is a side elevational view of the luminaire of the present invention in use with a moving vehicle.

Figure 2:
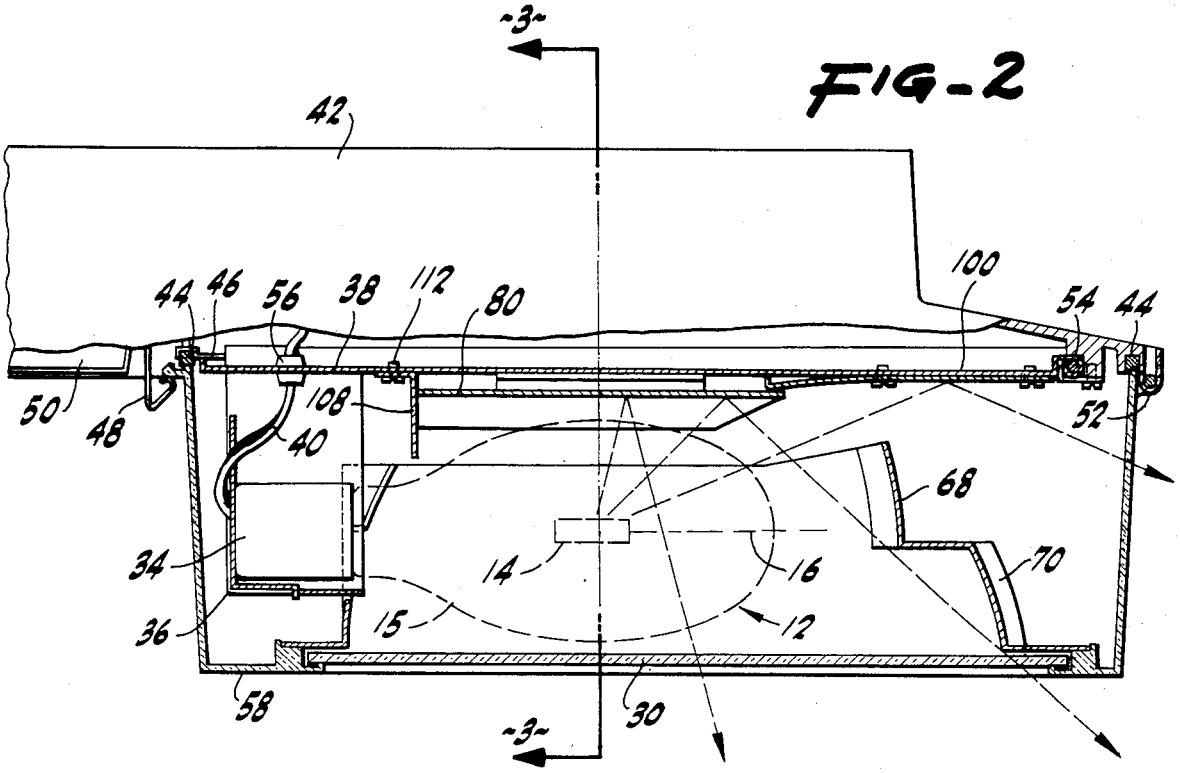
FIG. 2 is a sectional view taken along line 2—2 of FIG. 1.

For a better understanding of the invention reference is made to the following detailed description of the preferred embodiments thereof which will become apparent as the specification continues.

DESCRIPTION OF THE PREFERRED EMBODIMENTS

Various aspects of the present invention will evolve from the following detailed description of the preferred embodiments which should be referenced to the hereinabove described drawings.

The invention as a whole is shown in the drawings by reference character 10 and includes as one of its elements a source of light 12. Light source 12 includes an arc tube 14 which extends along axis 16, best shown in FIG. 2. A clear envelope enclosing arc tube 14 is preferred. Source of light 12 is supported within a housing, FIGS. 2, 3 and 6, which has a top portion 20, bottom portion 22, and side portion 24. Bottom portion 22 and side portion 24 include openings 26 and 28 having lenses 30 and 32 thereacross. Source of light or lamp 12 fits into socket 34 mounted within socket bracket 36 which is held to housing partition 38. Electrical conductors 40 electrically link lamp 12 and socket 34 through the appropriate ballast, electronics, and the like which are found within box 42 at the top of housing 18, FIGS. 2, 3 and 6. For example, ballast and starter mechanism serial number 123-93-509 manufactured by Universal Transformer Company in Patterson, N.J. would suffice. Bracket 38 serves as the floor to the box 42. A gasket 44 surrounds the top 18 and forms a seal between the same and side lens 32. Flange 46 connected to partition 38 partially surrounds gasket 34 to the rear of lamp 12, FIG. 2. Latch 48 fastened to mounting member 50 engages side lens 32 and holds the same in place. Mounting member 50 would connect to pole 52 by any suitable means known in the art. Side lens 32 pivots about hinge pin 52 when latch 48 is released. In addition, partition 38 would also hinge downwardly about hinge pin 54 when latch 48 is released. Thus, access is gained to the lamp 12 and the ballast associated and electronics within box 42. Of course, conductors 40 which are held to partition 38 by grommet 56 would not hinder a rotation of side lens 32, socket 36, and partition 38, since a slack length of conductor would be provided above partition 38 within box 42.

Side lens 32 is constructed with a rim 58 which supports bottom lens 30 as well as lower reflector system 60, FIG. 2. Rotation of side lens 32 downwardly about hinge pin 52 would also permit access to bottom lens 30 and lower reflector system 60 for maintenance purposes.

Figure 3:
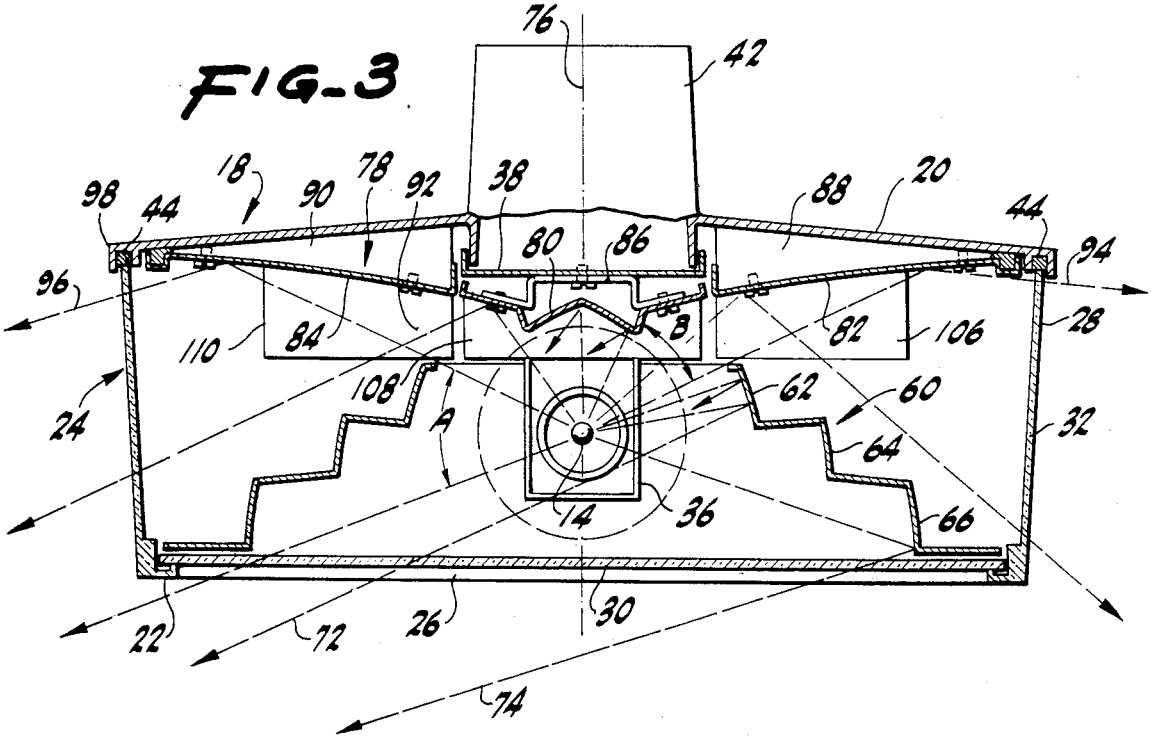
FIG. 3 is a sectional view taken along line 3—3 of FIG. 2.
Figure 4:
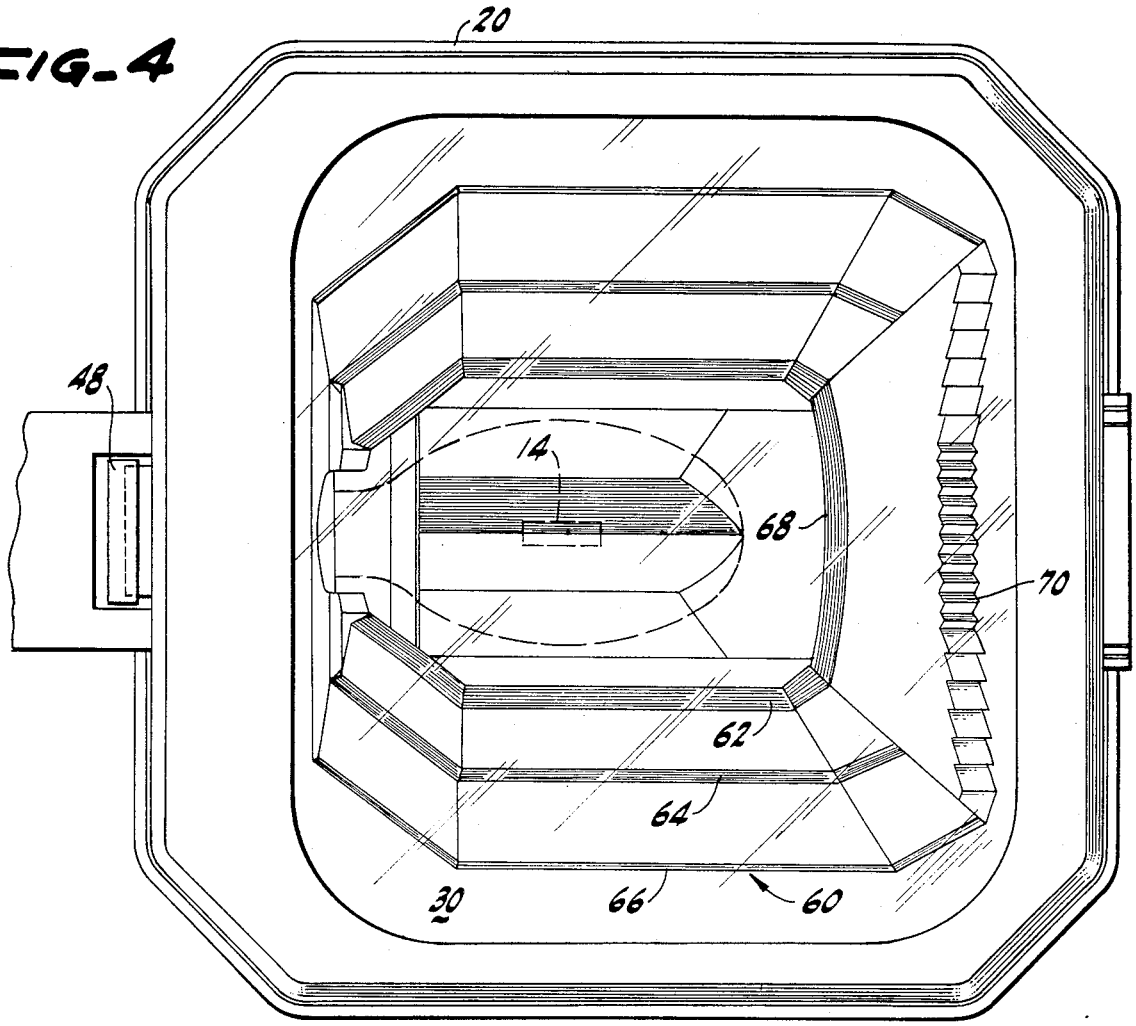
FIG. 4 is a bottom plan view of the luminaire of the present invention shown in FIGS. 1-3.

With reference to FIGS. 2, 3 and 4, lower reflector system 60 includes reflecting surfaces 62, 64, and 66 on either side and generally to the rear of arc tube 14. Reflector surfaces 68 and 70 are found forward of arc tube 14; reflector surfaces 70 being stepped to prevent light from returning to the rear portion of lamp 12, often referred to as the "house side" of luminaire 10. Likewise, the area to the front of lamp 12 is generally referred to as the "street side" of luminaire 10.

Returning to FIG. 3 it may be seen that light emanating from arc tube 14 and alternately reflected by lower reflector systems 60, would lie in a sector having an angle A. Angle A has been found to be generally a maximum of 30 degrees. The light reflected within the annular sector of angle A would generally be "high" angles of emission, generally between 65 degrees and 75 degrees in relation to vertical plane 76. Rays 72 and 74 represent such light reflected from lower reflector system 60.

Luminaire 10 also is constructed with an upper reflector system 78. Upper reflector system 78 entails a first reflector 80 which is positioned generally above arc tube 14. Second reflector 82 and third reflector 84 flank first reflector 80. First reflector 80 includes a bracket 86 which is fastened to ribs 88 and 90 which depend from top 20.

Again referring to FIG. 3 it may be seen that light passes from source 12 through a gap 92 formed between lower reflector system 60 and upper reflector system 78. Specifically, light emanates in an annular sector generated by angle B. Light passing through gap 92 is reflected from upper reflectors 82 and 84 at high angles of emission. This reflected light, shown by rays 94 and 96, strike side lens 32 at angles which are close to a perpendicular angle. It has been found that the loss of light through reflection from side lens 32 is less than ten percent, a far better result than is achieved by passing all light through lens 30. Thus, the light directed outwardly by reflectors 82 and 84 are used to reinforce light reflected by lower reflector system 60, i.e. at high angles of emission. It should be noted that top 20 includes a flange 98 which may serve as a weather shield.

Figure 5:
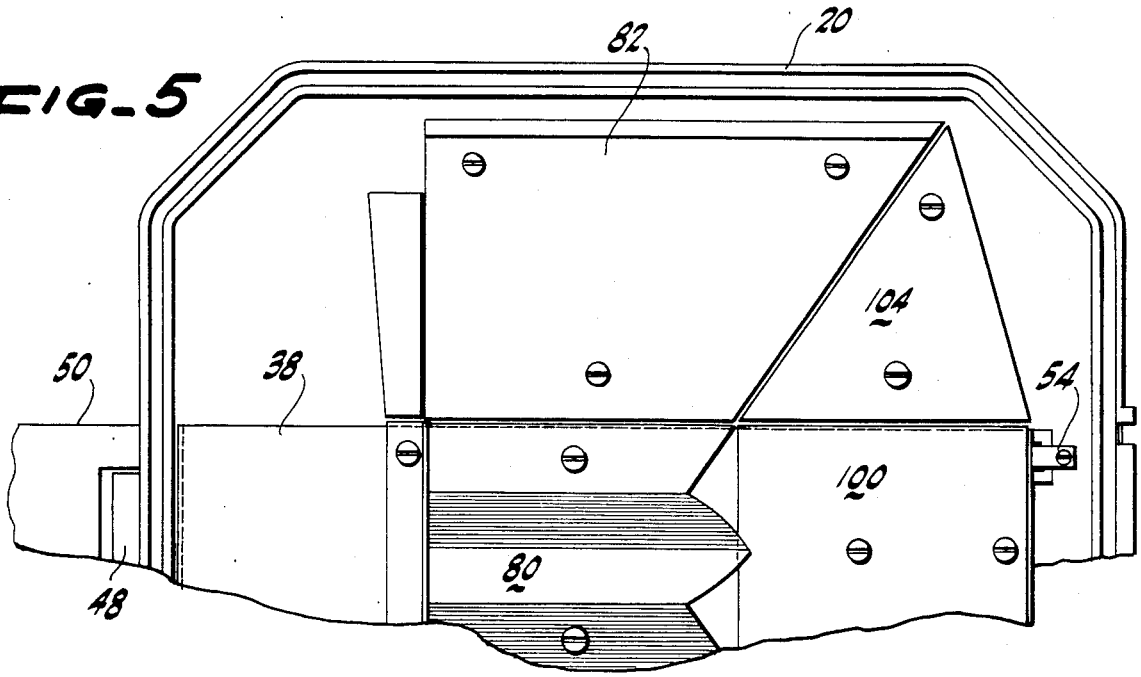
FIG. 5 is a partial bottom plan view of the upper reflector section of the luminaire of the present invention having the lamp, lenses, and lower reflector sections removed.
Figure 8:
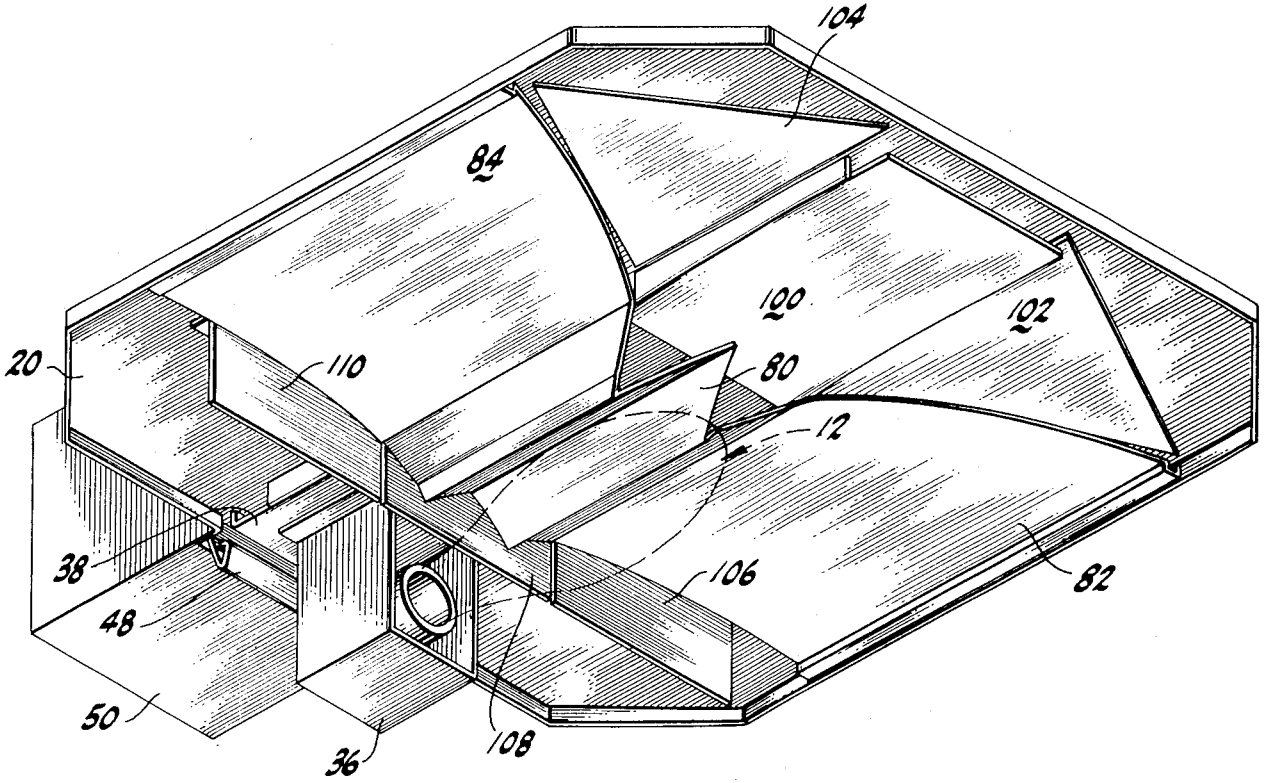
FIG. 8 is a bottom right perspective view of the reflector system of the luminaire of the present invention.

Looking at FIGS. 2, 5, 7 and 8 upper reflector system 78 also includes reflectors 100, 102 and 104 which also reflect light outwardly and toward the street side of luminaire 10 at generally high angles of emission. As FIG. 5 depicts, reflectors 100, 102 and 104 are fastened by fastening means, such as set screws, to top 20. Rear reflectors 106, 108 and 110 are fastened to partition 38 via fastening means 112. These rear reflectors generally direct light upwardly toward the upper reflector system 78, thus, controlling the light shining to the house side of luminaire 10.

With reference to FIG. 1 it may be seen that light is distributed by luminaire 10 to a zone 114 which is the heretofore described high angle zone of emission. Light is also distributed to zone 116 at lower angles of emission. Zone 118 represents the glare zone i.e. light having an angle of emission generally above 75 degrees. It has been found that the candle power of luminaire 10 peaks at an angle of emission of as much as 75 degrees and gradually diminishes as the angle decreases, FIG. 3. The arrangement of upper reflector system 78 and lower reflector system 60 around light source 12, also serves as a glare cut-off system, i.e. the light emanating from luminaire 10 greatly decreases above approximately 75 degrees.

Luminaire 10 may have application to roadway lighting using the "illuminance" system or the "luminance" system. The former includes a basis which simply measures the horizontal foot-candle level on the lighted surface at each point. On the other hand the latter measures the amount of light reflected from the surface to the observer's line of sight. Consequently, the reflectance characteristics of the road surface and the direction of travel of the observer relative to the luminaire must all be taken into account. Where a roadway surface is highly diffuse the required pattern of distribution in the luminance standard is very much like the one for the illuminance system. However, where a roadway surface is highly specular, light directed toward an observer in motor vehicle 120 "upstream" will be highly visible. Meanwhile, light directed downstream from motor vehicle 120 will largely reflect away from the motorist and appear greatly diminished in intensity. Therefore, the light directed downstream must be reinforced significantly to produce a more uniform luminance on roadway surface 122 which is highly specular. Luminaire 10 may include means 124 for adjusting the direction of light reflected from reflector 80 in relation to the light reflected from the reflecting surface 82. Means 124 may take the form of replacing reflector 80 with a reflector 80A, FIG. 6. Also, bracket 86 would be replaced by a new bracket 86A resulting in a cutoff or blocking of light to reflector 84. In addition, the light reflected from reflector 80A would include high angle light represented by ray 156. Rays 156, 157 and 159 represents light thrown at proper down stream angles causing the proper distribution of light on the surface 122 such that the peak intensity occurs about 60 degrees from pole 52. Reflector 84 could be removed in this embodiment.

Turning to FIG. 7 it may be seen that the downstream light from the FIG. 6 luminaire is reinforced as required by highly specular surface 122 under the luminance standard. It has been determined with luminaire 10 of FIG. 6 that the upstream peak diminishes as required from the embodiment shown in FIG. 3, but peaks at close to 75 degrees. Also, the downstream candle power has been reinforced up to approximately 68 degrees from the vertical plane 76. In FIGS. 6 and 7 it should be noted that reflector 82 of FIG. 3 has also been replaced by reflector 82A.

In summary, the above described changes constituting means 124 for adjusting the direction of light reflected from first reflector 80 may be easily accomplished without affecting the structure of luminaire 10. In other words, the specularity of the reflectors and the shielding of the lamp remain the same in both configurations shown in FIGS. 3 and 6.

It should be noted that luminaire 10 is anticipated for use with similar luminaires along a roadway on either side of the same. In the case where luminaires are staggered along a roadway, reflector 80A may be alternated from the configuration shown in FIG. 6, to an opposite configuration which blocks the light to reflector 82A.

Figure 9:
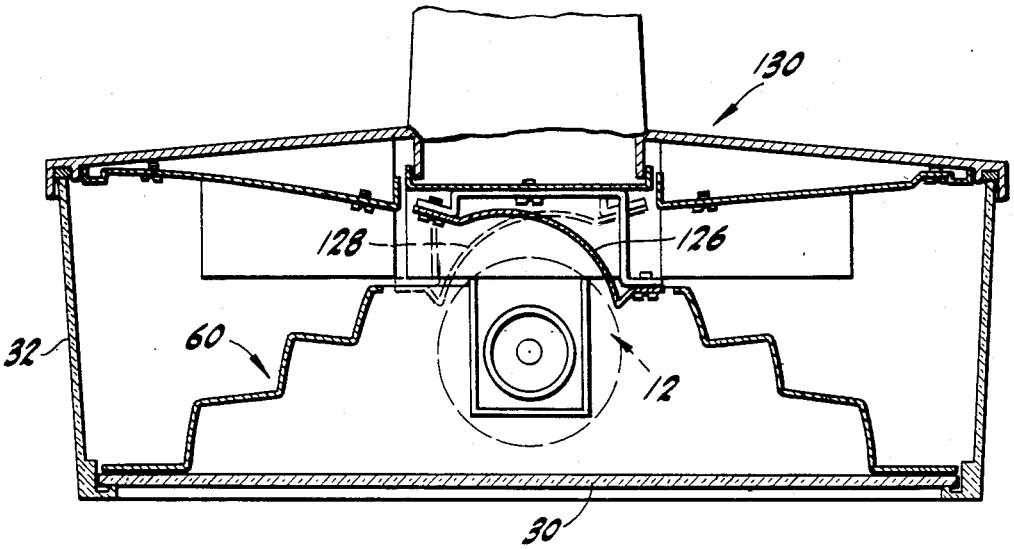
FIG. 9 is a sectional view similar to FIGS. 2 and 6 depicting another embodiment of the present invention.
Figure 10:
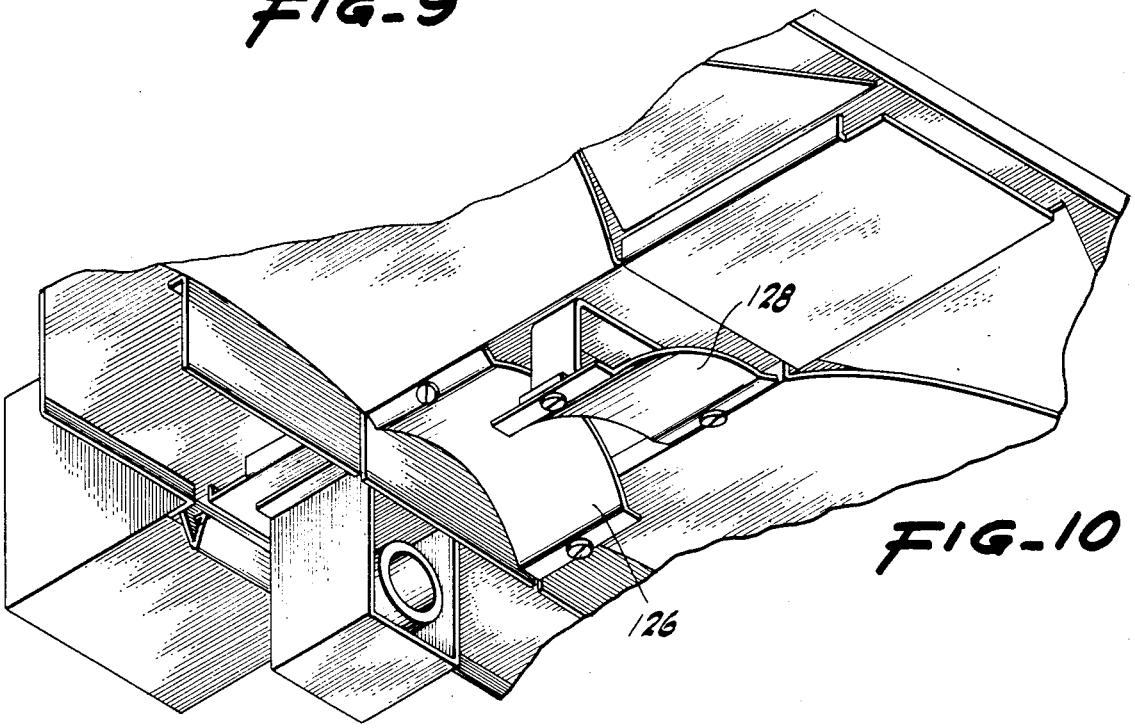
FIG. 10 is a bottom perspective view of the embodiment of the present invention shown in FIG. 9.
Figure 10A:
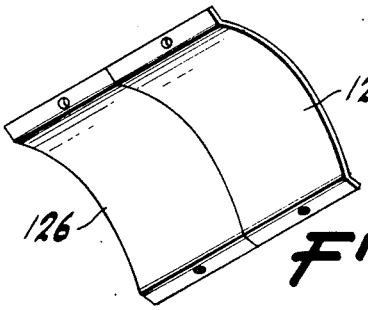
FIG. 10A is a bottom perspective view of an embodiment of the split first reflector.
Figure 10B:
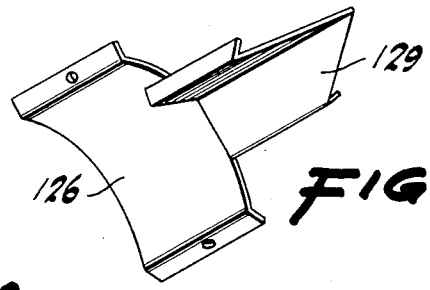
FIG. 10B is a bottom perspective view of another embodiment of the split first reflector.

With reference to FIGS. 9, 10, 10A and 10B luminaire 130 (FIGS. 9 and 10) is shown as a different embodiment of the present invention. Reflector 80A (luminance standard) of FIG. 6 has been split into a pair of reflector sections 126 and 128, FIGS. 9 and 10, which reflect light to opposite sides of light source 12 FIG. 10A depicts reflector sections 126 and 128 in a substantially parallel orientation. In FIG. 10B reflector section 129 of the illuminance standard, has been substituted for reflector section 128. Section 129 corresponds to the general contours of reflector 80 of FIG. 3.

Figure 11:
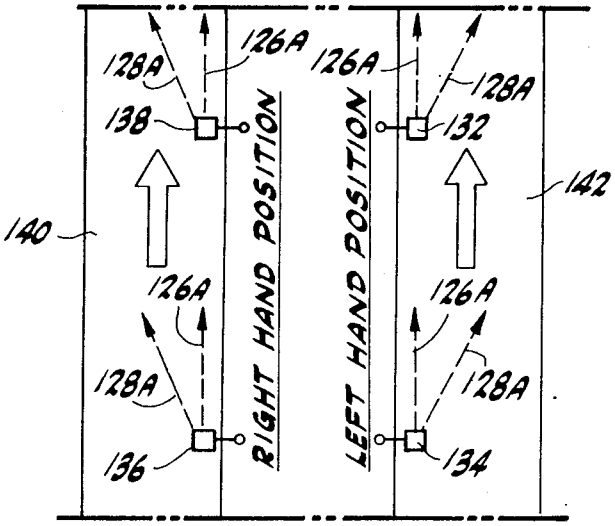
FIG. 11 is a schematic plan view of one-way roadway with luminaires of the present invention in place.
Figure 12:
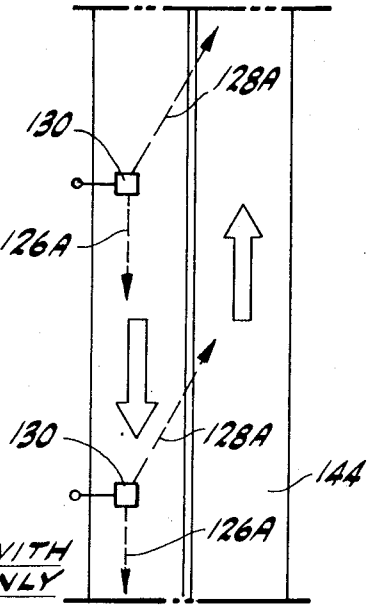
FIG. 12 is a schematic plan view of a narrow two-way roadway with luminaires of the present invention in place.
Figure 13:
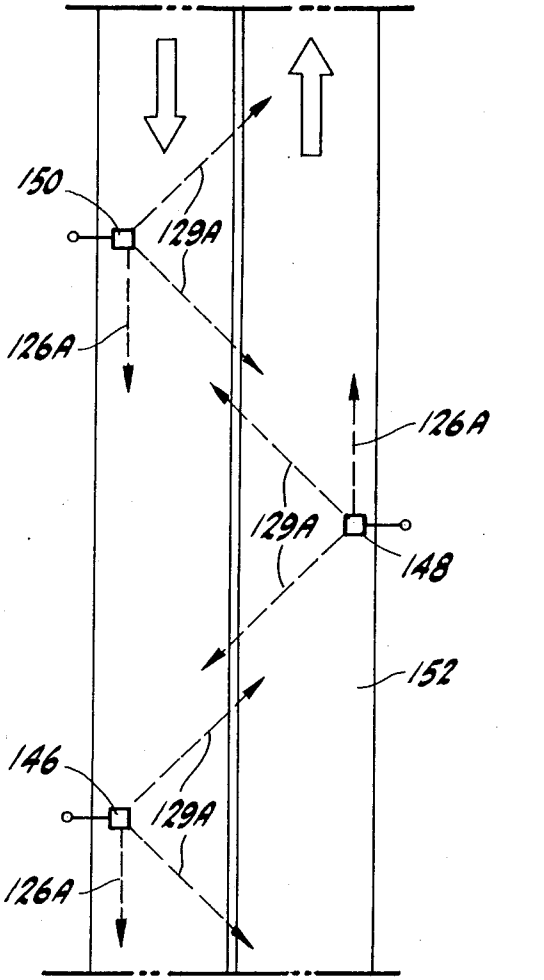
FIG. 13 is a schematic plan view of a wide two-way roadway with the luminaire of the present invention in place.

Turning to FIGS. 11–13, it may be observed that various luminaires having reflectors as above described possess separate applications in relation to roadways. For example, in FIG. 11, luminaires 132, 134, 136 and 138 include reflectors 126 and 128 of FIG. 9 and 10 but are oriented same way, lying substantially parallel to one another, FIG. 10A, to reinforce downstream light according to arrows 126A and 128A. The arrows 126A and 128A of luminaires 132, 134, 136 and 138 bear the same reference character plus the letter "A" as the reflectors shown in FIG. 10A. FIGS. 11–13 are similarly denoted. FIG. 11 illustrates the use of the luminaire of the present invention on one-way roads 140 and 142 with the luminaires 132, 134, 136 and 138 mounted on either side of roadways 140 and 142.

FIG. 12, in contrast, utilizes the exact configuration of reflectors 126 and 128 of FIGS. 9 and 10 i.e. oppositely oriented, on a narrow two-way road 144.

The FIG. 13 application employs the reflector system shown in FIG. 10B with a reflector 126 and an illuminance type reflector 129. Luminaires 146, 148 and 150 position on a wide two-way road 152. The directional arrows in FIG. 13 represent the light reinforcement for both the luminance and illuminance systems according to the particular reflector.

In addition, it has been found that a typical mounting height of 30 feet, luminaire 10 may be laterally spaced at approximately six and one quarter mounting heights. This compares favorably to five mounting heights of the prior art devices. Thus, with wider spacing capabilities fewer luminaires of the type show in the present invention are required to light a surface.

While in the foregoing embodiments of the present invention have been set forth in considerable detail for the purpose of making a complete disclosure of the invention, it may be apparent to those of skill in that art that numerous changes may be made in such detail without departing from the spirit and principles of the invention.

What is claimed is:

1. A roadway luminaire comprising:

a. a source of light;

b. a first reflector supported a distance from said source of light, said first reflector including a reflecting surface for reflecting light from said source away from said source of light;

c. a second reflector supported adjacent said first reflector, said second reflector including a reflecting surface for reflecting light away from and to one side of said source of light;

d. a third reflector, said first reflector being positioned between said second and third reflectors, said third reflector including a reflecting surface for reflecting light from said source away from and to another side of said source of light;

e. a lower reflector system positioned below said first and second reflectors, said lower reflector system including a lower reflector having a reflecting surface for reflecting light from said light source away from said source of light, said lower reflector system forming a gap in relation to said second reflector, said gap permitting light from said light source to pass to said second reflector, light reflected from said second reflector passing behind said reflecting surface of said lower reflector;

f. means for adjusting the direction of said light reflected from said first reflector in relation to the light reflected from said surface of said reflector;

g. a housing frame including a top, bottom, and side portion, said housing frame having a bottom opening and a side opening, said light reflected from said reflecting surfaces of said first and lower reflectors passing through said bottom opening of said housing frame and said light reflected from said reflecting surface of said second and third reflectors passing through said side opening of said housing frame behind said reflecting surface of said lower reflector.

2. The roadway luminaire of claim 1 in which said means for adjusting the direction of said light reflected from said first reflector further comprises means for blocking light from said source to said third reflector.

3. A roadway luminaire comprising:

a. a source of light;

b. a housing for supporting said source of light, said housing including a bottom opening and a side opening positioned at a selected angle in relation to said bottom opening said bottom and side opening permitting the passage of light from said source of light;

c. a first reflector supported by said housing a distance from said source of light, said first relector including a reflecting surface for reflecting light from said source away from said source of light and through said bottom opening of said housing, said first reflector being split into a first section and a second section, said first section of said first reflector being oriented to reflect light from said source of light to one side of said source of light and said second section said first reflector being oriented to reflect light from said source of light to another side of said source of light;

d. a second relector supported by said housing adjacent said first reflector, said second reflector including a reflecting surface for reflecting light away from said source of light and through said side opening of said housing on one side of said source of light.

4. The roadway luminaire of claim 3 in which said reflecting surface of said first section of said first reflector possesses a contour different from the contour of said reflecting surface of said second section of said first reflector.

5. The roadway luminaire of claim 3 in which additionally comprises a third reflector supported by said housing, said first reflector being positioned between said second and third reflectors, said third reflector including a reflecting surface for reflecting light from said source and through said side opening on another side of said source of light.

6. The roadway luminaire of claim 5 which additionally comprises a fourth reflector supported by said housing, said fourth reflector being displaced from said second and third reflectors in a direction toward said bottom opening of said housing, said fourth reflector further including a reflecting surface for reflecting light from said source of light away from said source of light and through said bottom opening of said housing.

7. A roadway luminaire comprising:

a. a source of light;

b. a housing frame including a top, bottom and side portion, said housing frame having a bottom opening and a side opening and means for supporting said source of light within said housing frame between said top and bottom of said housing frame;

c. an upper reflector system positioned between said source of light and said top of said housing frame, said upper reflector system including a first relecting surface for reflecting light from said light source directly through said bottom opening of said housing frame and a second reflecting surface for reflecting light from said light source through side opening of said housing frame;

d. a lower reflector system positoned below said upper reflector system such that a gap forms between said lower reflector system and said upper reflector system to permit a substantial portion of light from said light source to pass directly to said upper reflector system through said gap only for reflection by said upper reflector system directly through said side opening in said housing frame, said lower reflector system including a reflecting surface for reflecting light from said light source directly through said bottom opening of said housing frame, said source of light projecting light directly through said bottom opening.

8. The roadway luminaire of claim 7 in which said side and bottom openings of said housing frame include lenses.

* * * * *